US006561392B2

(12) United States Patent
Lapace et al.

(10) Patent No.: US 6,561,392 B2
(45) Date of Patent: May 13, 2003

(54) FOLDING ASSEMBLY

(75) Inventors: Christine L. Lapace, Tamarac, FL (US); Ronald J. Lapace, Tamarac, FL (US); Steve Ladue, Odessa, FL (US); Charles R. Smalley, Clearwater, FL (US)

(73) Assignee: Goldpace Enterprises, Inc., Miami, FL (US)

( * ) Notice: Subject to any disclaimer, the term of this patent is extended or adjusted under 35 U.S.C. 154(b) by 146 days.

(21) Appl. No.: 09/804,922

(22) Filed: Mar. 14, 2001

(65) Prior Publication Data

US 2001/0020630 A1 Sep. 13, 2001

Related U.S. Application Data

(63) Continuation of application No. 09/425,575, filed on Oct. 22, 1999, now Pat. No. 6,269,987.

(51) Int. Cl.[7] ..... A41M 43/00
(52) U.S. Cl. ..... 223/37; 493/405
(58) Field of Search ..... 223/37, 38, 120; 493/405; 211/19

(56) References Cited

U.S. PATENT DOCUMENTS 1,852,604 A * 4/1932 Canfield ..... 223/71
4,222,507 A * 9/1980 Bengtsson et al. ..... 223/37
4,421,500 A * 12/1983 Smith ..... 493/405
5,011,052 A * 4/1991 Craig ..... 223/37
5,137,190 A * 8/1992 Plaud ..... 223/33
6,015,069 A * 1/2000 Christensen ..... 223/37

* cited by examiner

*Primary Examiner*—Bibhu Mohanty
(74) *Attorney, Agent, or Firm*—Malloy & Malloy, P.A.

(57) ABSTRACT

A folding assembly structured to arrange any one of a plurality of different articles into a folded orientation and including an orienting device having a main segment and at least two outwardly extending and spaced apart side segments, wherein the main segments and two side segments are initially disposed in engaging relation to different portions of the article being folded. An attachment assembly in the form of a flexible material connector pivotally attaches each of the side segments in spaced relation to the main segment and outwardly spaced relation therefrom. The flexible material connectors thereby serve to accommodate the folding of articles of various thicknesses, in that they allow for the automatic spaced positioning of each of the sides segments at different spaced distances above the main segment as the different portions of the article are being oriented when the side segments are in a folded position. A support assembly comprises an elongated configuration selectively disposable into either a supporting position or a collapsed, stored position, wherein the supporting position is defined by disposing the orienting device at a convenient height above a supporting surface to facilitate the arranging of the articles into the preferred folded position. The support assembly also includes a brace assembly disposable into an operative and in-operative position to selectively support the side segments to define a support surface.

18 Claims, 6 Drawing Sheets

4/6

FOLDING ASSEMBLY

The present is a Continuation of previously filed, copending application Ser. No. 09/425,575 which was filed on Oct. 22, 1999 now U.S. Pat. No. 6,269,987, the contents of which are incorporated herein by reference.

BACKGROUND OF THE INVENTION

1. Field of the Invention

This invention relates to a folding assembly designed to facilitate the manual arrangement of any of a plurality of different articles into a folded orientation, on an independent basis, wherein various operative components of the folding assembly are expandable or extendable into their intended, operative position during the folding procedure, and are selectively disposable into a stored or collapsed, inoperative position to facilitate transport of the folding assembly between different locations.

2. Description of the Related Art

Numerous devices exist which are directed to the arrangement of garments, as well as other articles, in a predetermined, folded position. Such folding devices vary from small manually operated structures, which may be used at home or in an environment where only occasional folding is required, to large mechanized folding devices, which are extremely expensive and primarily designed for strictly commercial environments where garments or other articles are manufactured and/or packaged in extremely large numbers. Devices of the type set forth above are commercially available and are primarily directed to an attempt to save both time and labor, which would normally be expended if the process were relegated to laboriously hand folding each article. In addition, except in the home or domestic environment, the hand folding of garments or other articles is generally unacceptable due to the lack of uniformity resulting from such manual folding. It is of course recognized that such uniformity in appearance of the folded article is a necessity in a commercial or retail establishment, wherein the folded article is made available in a container or package of standard dimension and configuration, or the folded article is presented for display in a manner which is hopefully appealing to the consuming public.

Accordingly, depended upon the particular area of application, folding devices have primarily been designed for specialized applications, in order to accomplish either individual or bulk folding of a variety of different types of articles or of specific articles, such as shirts or the like. Therefore, with the exception of the bulk folding of articles, as primarily used in the garment industry, the individual folding of garments or other articles is usually accomplished either by the use of fully or semi-automatic machines; small, inexpensive and less than durable folding boards; small apparatus specifically designed to fold garments or other articles for purposes of packaging or, as set forth above, by the individual hand folding of each item. A recognized disadvantage of the above set forth categories of folding devices is their lack of versatility and inability to be used other than in the specialized field, for which they are initially designed. For example, there is certainly no need or use for a fully or semi-automatic folding machine in a commercial or retail establishment, such as a department store the like, where uniform folding is important but, wherein the quantity of articles that must be folded, or refolded does not justify the expense of such mechanized equipment. Moreover, such mechanized devices do not generally provide a desirable degree of portability so as to allow workers to gather and fold items conveniently at a display location. Alternatively, folding tables or like devices which are manually operated are typically formed from inexpensive, light weight material having a relatively short operable life and which are specifically not intended to accommodate the folding of large numbers of garments or other articles. Likewise, such less sophisticated devices are still somewhat cumbersome to manipulate and move to a desired folding location when a number of spaced display locations are present within a particular establishment.

Also, in certain locations such as department stores or other similar retail establishments, available space is at a premium. Accordingly, space dedicated to the storage of a folding table or like device is typically unavailable. Known or conventional garment folding assemblies, of the type set forth above, are not readily adaptable for use in locations where the folding of garments or other articles is necessary for either display or packaging, but where the storage space needed to maintain such folding tables is at a minimum or non-existent.

Therefore, based on the above disadvantages and the overall failure of known or conventional designs to incorporate sufficient versatility and mobility to be adaptable for use in a variety of different commercial, retail and/or domestic environments, there is an obvious need in this area for an improved folding assembly. Such an improved folding assembly should be capable of being operated manually, but should also have sufficient versatility to be used with any one of a wide variety of different types of article for arrangement thereof in a predetermined, folded orientation, resulting in the folded article having a sufficiently uniform appearance to facilitate its display and/or packaging. In addition, such an improved folding assembly should be inexpensive and light weight, yet be formed from materials and or structural components which assure a long operable life and which facilitate the folding device to be transported from location to location without placing undue stress on personnel responsible for its re-location or transport. Finally, an improved folding assembly of the type referred to herein should be capable of being selectively oriented in either an operative position or a collapsed position, wherein when in the collapsed position, the improved folding assembly has a significantly reduced size and configuration so as to be conveniently stored in any of a variety of locations, particularly in establishments where storage space is at a minimum.

SUMMARY OF THE INVENTION

The present invention relates to a folding assembly designed to arrange any of a wide variety of articles into a folded orientation by the manual manipulation of an orientation device. The orientation device comprises a main, centrally disposed segment and at least two side segments extending laterally outward from the main segment in spaced relation thereto. An attachment assembly, which is preferably formed from a flexible material, movably interconnects each of the side segments to opposite sides of the main segment or in another embodiment to other substantially oppositely disposed structural components of the orienting device, as will be explained in greater detail hereinafter. In either embodiment, the side segments are movably secured to the orienting device in a manner which allows the independent, substantially pivotal movement of each of the side segments in alternate fashion, from an outwardly extended position, for initial support of a garment or other article thereon, to a substantially overlying position relative to the main segment, thereby accomplishing a portion of the folded orientation. The main segment, as well as each of side segments, may of course vary in dimension and configuration, dependent upon the type and/or size of the article being folded. However, an overall dimension or configuration of each of the main and side segments is preferably such as to allow sufficient versatility to enable the orientation device to be used in the folding of any number of a variety of different articles of a variety of different sizes and thicknesses. Also, regardless of the type of articles being folded, a substantially uniform fold will be the result.

One structural feature of the present invention is the aforementioned attachment assembly, wherein at least one attachment member extends outwardly from opposite sides or peripheral portions of the main segment into movable securement with a correspondingly positioned side or peripheral portion of each of the individual side segments. Accordingly, when in their expanded position, each of the side segments are disposed laterally outward from the main segment in spaced apart relation thereto. However, when the side segments are alternately disposed into a folded position, the flexibility of the attachment member allows for the free pivotal movement as well as an automatic adjustment to accommodate the thickness of the material from which an article is formed or the overall thickness of the article being folded. It should be apparent therefore that the folding assembly of the present invention is readily adaptable for use in folding articles or garments formed of a variety different types of materials, without changing the configuration or dimension or being forced to adjust the relative positions of the operative components of the folding assembly, such as the main segment and side segments, relative to one another.

Another feature of the present invention is the provision of a support assembly, which, when in a supporting position, engages and positions the orienting device, including the main segment and outwardly extending side segments, at a preferred height above a floor, platform or other supporting surface on which the folding assembly of the present invention is disposed. The height of the support assembly can be regulated in order to position the orienting device at a desired location to accomplish the process of folding dependent on the particular location or area where the folding processes occurs.

In addition, the support assembly of the present invention comprises a plurality of support members or legs which, as set forth in greater detail hereinafter, may be more specifically comprised of pivotally attached leg pairs. The leg pairs are selectively positioned, along with the other components of the support assembly, into either a supporting position, as described above, or a stored position. The stored position facilitates the hand carrying of the folding assembly or movement of the folding assembly of the present invention, between different locations, where it is being used. Moreover, to facilitate such transport, a plurality of rollers, casters or like structure, hereinafter collectively referred to as a roller assembly, may be secured to the bottom end or adjacent portion of the support members, in order to facilitate the rolling of the support assembly, when the support assembly is in either its supporting position or its stored position, to a desired location.

In order to facilitate a stable engagement and support with the orientation device, as described above, the support assembly further includes a base which is connected to what may be considered an upper end of the plurality of legs or support members. When the support assembly is in its supporting position the base is disposed in supporting engagement with at least the main segment of the orienting device. It should also be noted that the orienting device, including the main segment and the two or more side segments, may be removably secured to the support assembly, including the base, or alternatively may be fixedly attached thereto in a manner which allows the independent movement of each of the side segments relative to the main segment. In the embodiment comprising a fixed attachment, the base may be fixedly secured by any of a variety of applicable structures to the main segment, such that the two side segments are allowed to be collectively positioned between the aforementioned outwardly extended, supporting position and/or in a folded, stored position, as required.

Yet another feature of the present invention comprises the provision of a brace assembly movably mounted on the support assembly in adjacent, co-operative relation to the base. The brace assembly is co-operatively structured with the base, as well as other associated parts of the support assembly, to be selectively disposed in either an operative position or an inoperative position. The position of the brace assembly may at least partially depend on whether the support assembly is disposed in its supporting position and/or stored position, as described above. More specifically, the brace assembly comprises at least two brace members each of which are movably disposed outwardly from opposite sides and/or substantially oppositely disposed peripheral portions of the base and into supporting engagement with an under portion of different ones of the side segments. The outwardly extending position of the brace members thereby defines the aforementioned operative position of the brace assembly so as to define a rigid table type support surface. In one embodiment, each of brace members are slidingly connected to the base and/or an under portion thereof, in the vicinity of the upper end of the support assembly, such that each of the brace members may be independently extended outwardly from the base different distances, dependent on the size, configuration and/or location of the respective side segments which they support. The in-operative position of the brace members is at least partially defined by their respective disposition in immediately adjacent and/or contiguous relation to the base and more particularly to the correspondingly disposed sides or peripheral portions thereof, from which they normally extend when in the above described operative position.

Based on the above, it should be apparent that the folding assembly of the present invention comprises an improved folding device for any number of different garments or a variety of other articles, any of which may by formed from material having a different thickness, wherein any one the various types of the articles may be arranged in a folded orientation in a quick and easy manner, without requiring replacement, adjustments or repositioning of any of the operative, structural components of the folding assembly. Moreover, the folding assembly also provides an easily transportable, multi-function support surface.

These and other features of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
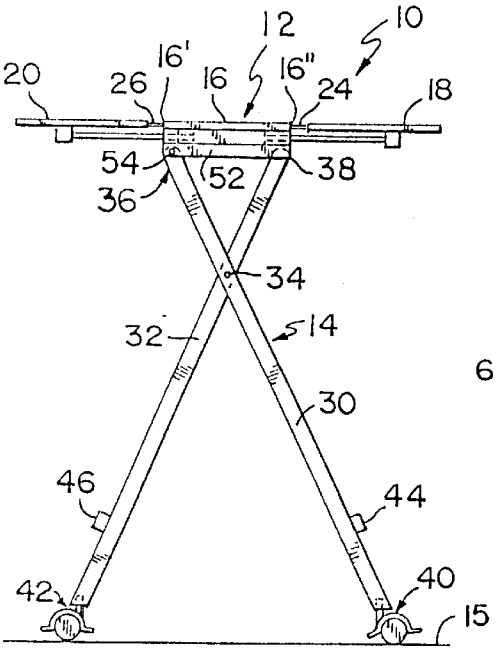
FIG. 1 is an end view of the folding assembly of the present invention in a position ready for use.
Figure 2:
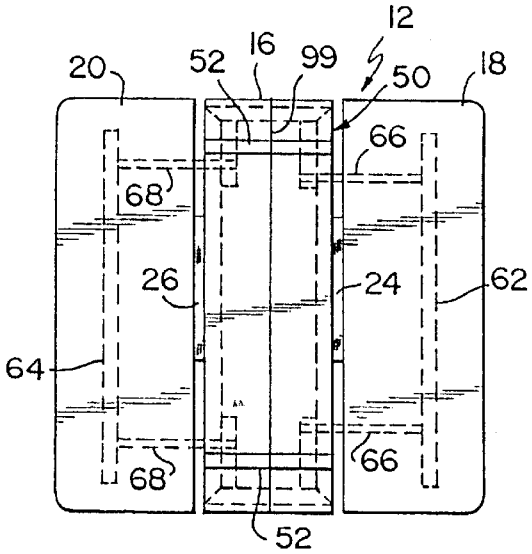
FIG. 2 is top plan view of the embodiment of FIG. 1.

As shown in the accompanying drawings, the present invention relates to a folding assembly generally indicated as 10 including an orienting device generally indicated as 12, and a support assembly generally indicated as 14. With primary reference to FIGS. 1 through 3, the orienting device 12 includes at least a main, substantially centrally disposed segment 16 and two side segments 18 and 20. The orienting device may be selectively disposed in either an expanded position, as best shown in FIGS. 1 and 2, or a folded position, as successively depicted in FIGS. 8 through 10, which will be explained in greater detail hereinafter.

Each of the main segment 16 and at least two side segments 18 and 20, may each comprise a substantially flat sheet or panel-like configuration, formed from a substantially rigid or, depending upon the type of articles being folded, at least partially flexible material. Moreover, preferably etched, drawn, attached, or otherwise defined on the main segment 16 is a center line 99, which provides a guide for the center of an article to be folded. When the side segments 18 and 20 are disposed in their expanded position, they are positioned outwardly from opposite sides or, depending upon the configuration of the main segments 16, opposite peripheral portions as at 16' and 16". Further, each of the side segments 18 and 20 are preferably coupled in spaced apart relation to the correspondingly disposed peripheral portions or sides 16' and 16", through the provision of an attachment assembly.

Although the attachment assembly may include any of a variety of hinge defining structures, in the illustrated embodiment, the attachment assembly of the present invention is preferably formed of a flexible material, such as but not limited to a high strength, flexible canvas, plastic, or other applicable flexible material. In the embodiment of FIG. 2, the attachment assembly comprises at least two flexible material straps or equivalently structured connector elements 24 and 26, each of which serve to interconnect a different one of the side segments 18 and 20 respectively, to the main segment 16, in spaced apart relation to the correspondingly disposed peripheral portions or sides 16' and 16" respectively. It is emphasized that the attachment assembly may differ from the embodiment shown in FIG. 2, in that the length of each of the flexible material connector elements 24 and 26 may be increased or decreased or alternatively, a plurality of such connector elements 24 and 26 may extend in spaced relation to one another between the main segment 16 and each of the side segments 18 and 20. As a result of the connector elements 24 and 26 being formed from a flexible material, a substantial degree of versatility and variability is added to the folding procedure. This applies in terms of the types of articles being folded, as well as the physical characteristics, including but not limited to the "thickness" of the material from which the various folded articles are formed. The versatile feature will be more specifically described with regard to the folding procedure depicted in FIGS. 8 through 10 hereinafter. However, it is noted that gaps of varying dimensions are defined by the same attachment assembly so as to conform to the clothing article being folded.

Figure 8:
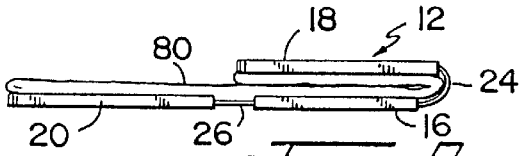
FIG. 8 is a schematic representation of an orienting device of the embodiment of FIGS. 1 through 3, depicting the disposition of certain structural components during the process of folding an article.
Figure 9:
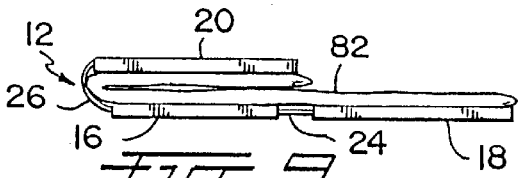
FIG. 9 is a schematic view of a different step in the folding process, other than that shown in FIG. 8.

In order to provide such versatility, it is further emphasized that the size, configuration and material from which the connector elements 24 and 26 are formed can vary as long as sufficient flexibility is provided in allowing a substantially "pivotal" type of movement of the side segments 18 and 20, into their respective folded position, as shown in FIGS. 8 and 9, during the folding procedure. In addition, the material from which the connector members 24 and 26 are formed can even be elastic, so as to somewhat vary the initial spacing between the side segments 18 and 20 and the main segments 16, such as when the elastic material connector members are stretched. Alternatively, the length of the connector members 24 and 26 can be selectively varied in terms of extending or retracting the length between the corresponding peripheral portions of each of the side segments 18 and 20 and the respective sides or peripheral portions 16' and 16" of the main segments 16.

Figure 3:
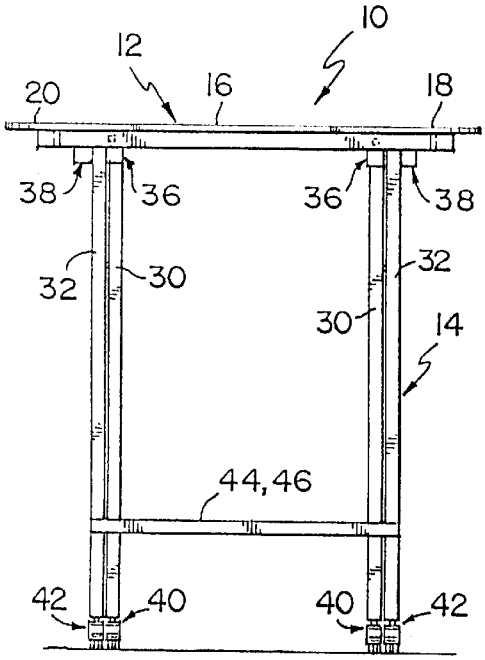
FIG. 3 is a side view of the embodiment of FIGS. 1 and 2.
Figure 4:
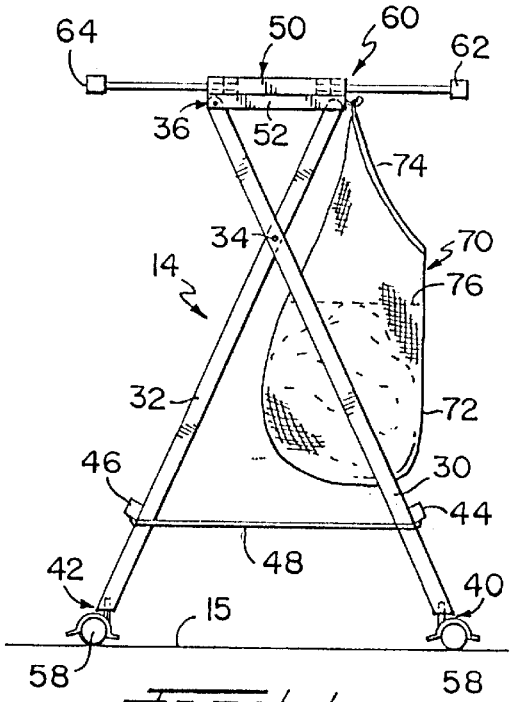
FIG. 4 is an end view of a support assembly associated with the embodiment of FIGS. 1 through 3.
Figure 3A:
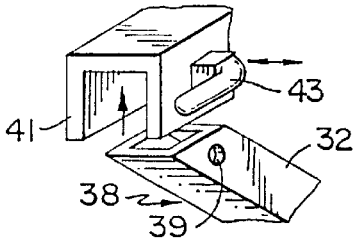
FIG. 3A is perspective view in partial cutaway of additional structural details of a support assembly of the present invention.

Another feature of the folding assembly 10 of the present invention comprises the aforementioned support assembly 14 which, in at least one embodiment has a somewhat elongated configuration and, when in its supporting position as shown in FIGS. 1 through 4, is substantially vertically oriented so as to position the orienting device 12 in a vertically spaced relation to a floor, support platform or other supporting surface 15 on which the folding assembly 10 is disposed, thereby defining a table or like support article. More specifically, the support assembly 14 comprises a plurality of support members generally in the form of legs or "leg pairs" 30 and 32. The leg pairs 30 and 32 are pivotally connected to one another as at 34 and include an upper or top end generally indicated as 36 and 38 and a lower end, generally indicated as 40 and 42 respectively. Cross members 44 and 46 may be provided in order to assure the structural integrity and stability of the support assembly 14. In addition, a retaining member 48 may be disposed in interconnected relation between the leg pairs 30 and 32, preferably at the cross members 44 and 46, in order to limit the spaced apart distance between the lower portions of the leg pairs 30 and 32, when the support assembly 14 is in its supporting position as shown in FIGS. 1, 3 and 4.

In order to facilitate either the removal or fixed support of the orienting device 12, the support assembly 14 comprises a base 50 which may have an open or apertured construction or be in the form of a solid material panel. In either embodiment, end portions 52, which may be secured to an under portion or any other applicable portion of the base 50, are pivotally attached, as at 54, to an upper end 36 of one of the leg pairs 30. The upper end 38 of the other leg pair 32 is removably disposed in supporting engagement with the base 50 at an opposite end of the end portions 52 or any other location. In order to further assure stability of the support assembly and prevent inadvertent displacement of the base 50 from its substantially horizontal position, as shown in FIGS. 1 and 4, the upper end 38 of at least one of the legs of the leg pairs 32, may include an aperture 39. In addition, a bracket 41 may be correspondingly mounted or attached to the correspondingly disposed end portion 52 of the base 50, and is disposed and configured to receive the end 38 removably therein. A spring biased locking pin 43 is preferably mounted on bracket 41 and is positionable to removably pass through the aperture 39, when the end 38 is received within the interior of the bracket 41. Conversely, when it is desired to orient the support assembly 14 out of its substantially horizontal support position, the spring biased pin 43 is manually positioned outwardly from the aperture 39, thereby allowing the apertured end 38 of the leg or leg pairs 32 to be removed from the bracket 41. The base 50 is thereby disposed in a substantially horizontal orientation so as to dispose the main segment 16 of the orienting device 12 also in a substantially horizontal orientation during the folding procedure, and so as to provide sufficient support thereto in order to define a table top or like support surface.

Figure 7:
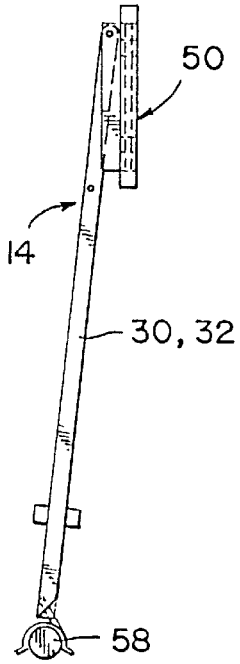
FIG. 7 is an end view of the support assembly of the embodiment of FIGS. 4 through 6, shown in a stored position.

By virtue of the pivotal connection 54 of the base 50, it may be selectively disposed in a somewhat aligned, immediately adjacent orientation relative to the plurality of support members or leg pairs 30 and 32 as represented in FIG. 7. FIG. 7 defines the support assembly 14 in its stored position for purposes of facilitating transport, including hand carrying, and/or storage. In addition, in its stored position, a roller assembly, comprising a plurality of rollers, casters, etc. 58 may be mounted on the lower most end 40 and 42 of the leg pairs 30 and 32 to accomplish transport of the stored support assembly by rolling, rather than hand carrying. Likewise, however, the casters 58 also substantially facilitate the transportability of the folding assembly 10 in its operative position, such as when a store employee wishes to move from location to location, folding and/or otherwise arranging articles on a given display. It should also be noted that in order to facilitate rolling transport or movement of the folding assembly 10 through a crowded area, such as within a retail clothing establishment, when the support assembly 14 is in its operative position, the lower ends 40 and 42 of the supporting leg pairs 30 and 32 are spaced outwardly from one another a greater distance than the width of the base 50. In particular, the relatively small transverse dimension or width of the base 50, as compared to the distance between the lower ends 40 and 42, facilitates travel of the folding assembly 10 between clothing or garment racks, wherein the space between the hanging garments on adjacently positioned garment racks is much less than the relatively greater space between the respective bases of the garment racks, beneath the supported garments. Accordingly, the relatively narrow or lesser transverse dimension of the base 50 facilitates the easy passage of the folding assembly 10 between adjacently disposed, but spaced apart, garment racks of the type commonly used when the support assembly 14 is in its vertically oriented, operative position, while still providing a wide and stable rolling surface. However, in some circumstances, the tight confines of a location may limit operative movement of the folding assembly 10, the complete and/or partial collapsing of the folding assembly 10 in the manners described herein can further ease maneuverability to a desired location.

Figure 16:
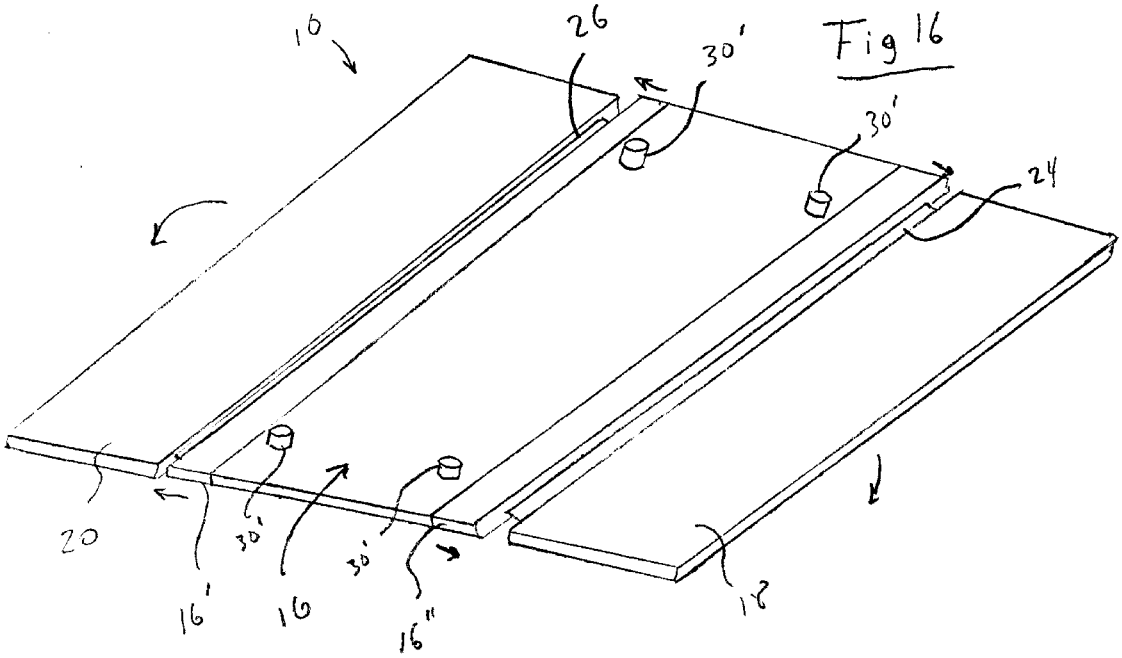
FIG. 16 is a bottom perspective view of another embodiment of the present invention including a shortened support assembly.

Looking to FIG. 16, it is also recognized that the support assembly may include one or more support members 30' that are substantially short in length. Such a configuration facilitates positioning of the folding assembly 10 on a table or counter top, or on an existing cart type structure. Of course, it is understood that no support assembly is required in some embodiments.

Figure 5:
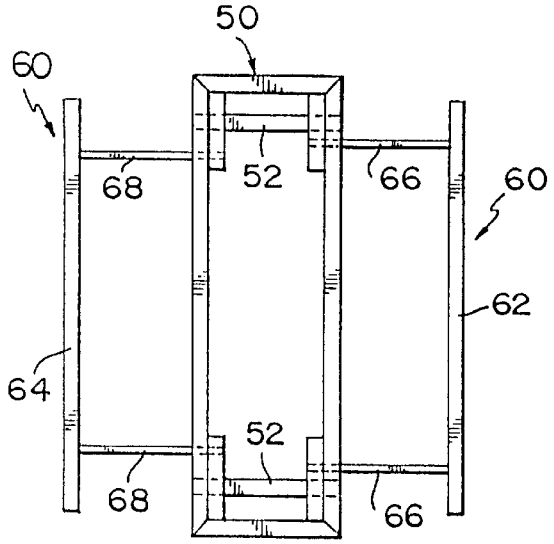
FIG. 5 is a top plan view of the embodiment of FIG. 4.
Figure 6:
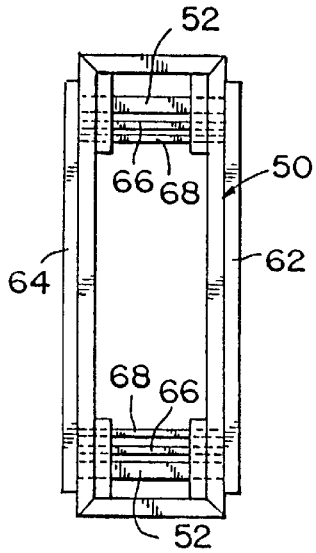
FIG. 6 is a top view of the embodiment of the support assembly of FIGS. 4 and 5, shown in an in-operative position.

Yet another feature of the present invention comprises the provision of a brace assembly, generally indicated as 60, wherein the brace assembly 60 includes at least two brace members 62 and 64 selectively positionable between an operative position as shown in FIGS. 2, 4, and 5 and an in-operative position as shown in FIG. 6. The brace assembly 60 is selectively positioned, when in its operative position, beneath and in supporting engagement with an under surface of the respectively disposed side segments 18 and 20. Each of the brace members 62 and 64 are independently moveable between the aforementioned operative position defined by their outwardly extended orientation, and the in-operative position defined by their orientation in immediately adjacent, substantially contiguous relation to the base 50. As best shown in FIG. 6, in order to accomplish such selective positioning, each of the brace members 62 and 64 preferably include outwardly extending, spaced apart legs 66 and 68 respectively. The legs or more precisely leg pairs 66 and 68 are slidingly attached to an under portion or other applicably disposed structure of the base 50. In addition, it is emphasized that the distance of outward spacing or extension of each of the brace members 62 and 64 may vary from a fully extended position, as shown in FIG. 5, to any number of partially extended positions (not shown), depending upon the overall size and/or configuration of the respective side segments 18 and 20, which the brace members 62 and 64 support. Also, as best shown in FIGS. 5 and 6 the spacing between the respective leg member 66 and 68, may vary in order that they would not interfere with one another, when they are disposed inwardly into the in operative position of FIG. 6.

In one embodiment, each of the brace members 62 and 64 are independently extendable or collapsible, thus the overall size of the support surface defined by the side segments 18 and 20 can also be varied to the needs of the user and/or the limits of a work area. For example, the preferred connector elements 24 and 26 are formed of a flexible material, and as a result preferably define a two way hinge structure. As a result, in addition to being foldable atop the main segment 16 so as to fold an article, such as a garment, the connector elements 24 and 26 also allow the side segments 18 and 20 to fold downwardly when the brace members 62 and 64 are not in their extended, supporting position. Accordingly, a variably sized work area can be provided and easily maneuvered and transported to a desired location.

Figure 18:
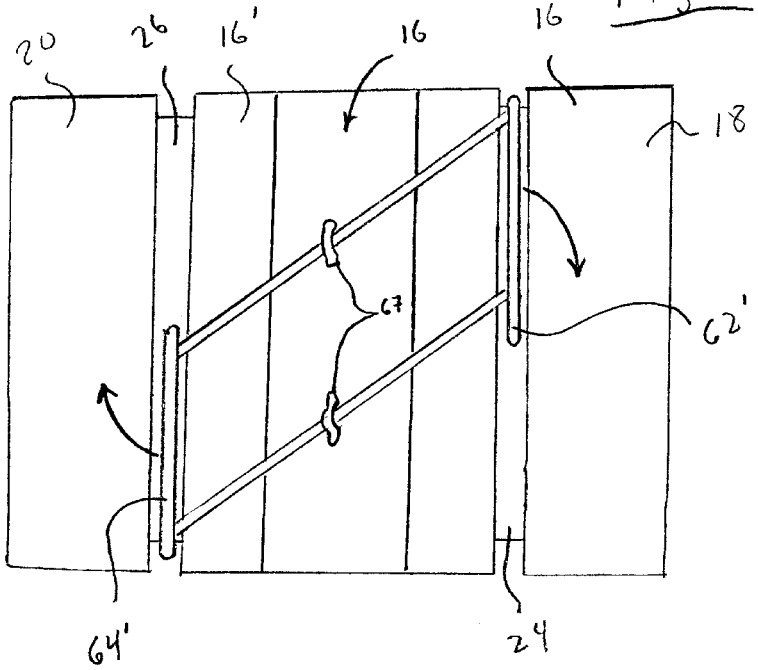
FIG. 18 is a bottom view illustrating an alternate embodiment of the brace members.

In yet another embodiment of the present invention, as in FIG. 18 the brace members 62' and 64' may be hingedly connected to the orienting device, such as indirectly via the base. Moreover, as shown, the brace members 62' and 64' may be coupled with one another so as to retract and expand in unison. In the illustrated embodiment, by pulling either one of the brace members away from the brace about the pivot joints 67, the other brace member is also in turn pulled outwardly into its expanded orientation. Also as can be seen from this and the previous embodiment, the brace members need not extend completely beneath the entire surface of the side segments.

Other structural features of the present invention may include the provision of a storage facility, generally indicated as 70, in the form of a bag, bin or other container 72, having any type of opening 74 communicating with the interior thereof. The storage facility 70 is provided in order to store articles, garments, etc. 76 therein, wherein such garments are yet to be folded and are disposed at an easily accessible location during folding and/or transport of the folding assembly.

Figure 10:
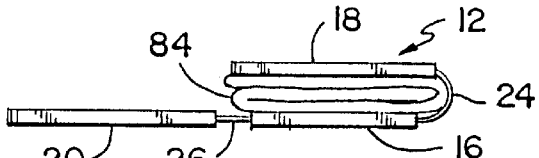
FIG. 10 is a schematic view of yet another step in the folding process.

As shown in FIGS. 8 through 10, the folding operation or procedure is accomplished by positioning an article or garment 80 in engaging relation with the main segment 16, in preferably aligned relation to the center line 99, as well as the side segments 18 and 20. A generally central or mid portion of the article 80 is disposed in overlying, supported relation on the main segment 16, wherein side or peripheral portions of the article 80 are disposed in overlying, supported relation on the side segments 18 and 20. The folding procedure is instigated by disposing one of the side segments 18 or 20, from its outwardly expanded position to its folded position as shown in FIG. 8. This will bring one portion of the article 80 into a folded orientation as shown in FIG. 8. FIG. 9 shows the other of the side segments as at 20 being first brought into its folded position rather than the side segment 18. Furthermore, in the embodiment of FIG. 8 a relatively thin material article is being folded, while to the contrary, in the embodiment of FIG. 9, a much thicker material article 82 is being folded. This demonstrates the versatility of the folding assembly 10 of the present invention, through the provision of the flexible material attachment assembly comprising the flexible material connector elements 24 and 26. Therefore, regardless of the "thickness" of the material from which the article is formed or its overall dimension after folding has been completed, the flexibility and overall structure of the connector elements 24 and/or 26 is such as to automatically accommodate and provide for the difference in the spacing between the main segment 16 and the side segment 18, when a relatively thin material article 80 is being folded, than when a relatively thick material article 82 is being folded. Further, FIG. 10 shows the resulting thicker dimension of the completely folded article 84 requiring the connector member 24 to extend outwardly a greater distance, when the end segment 18 is disposed in overlapping relation to the main segment 16, than is required of the connector element 26 when the end segment 20 is performing the first fold in FIG. 9.

Additionally, as shown in FIGS. 11 through 16, the folding assembly of the present invention includes another embodiment of the orienting device which is generally indicated therein as 12'. The orienting device 12' comprises a main segment 160 and at least two outwardly extending movably interconnected side segments 18' and 20' which operate in substantially the same fashion as described with reference to the embodiment of FIGS. 1 through 10. In addition, the orienting device 12' can be used in combination with the support assembly 14 as described with reference to FIGS. 1 through 7 above. However, in this alternate embodiment of the orienting device 12', it preferably includes at least one, but preferably two extension members, such as those generally indicated as 90 and 92, represented in at least partially operative and assembled form in FIG. 11 and depicted and explained in greater detail with reference to FIGS. 12 through 15. Since the structural details and operative features of each of the extension members 90 and 92 are substantially identical, a detailed description of one of the extension members 92 is meant to be inclusive of the structural and operative features of the other of the extension members.

More specifically, each of the extension members 90 and 92 are selectively positionable both towards and away from the respective sides 160' and 160" of the main segment 160, as indicated by directional arrow 97. As a result, the overall or effective size of the support surface of the main segment 160 can be correspondingly decreased or increased to meet the needs of the user relative to narrower and wider garments and other articles. Along these lines, it is noted that if desired, the entire main segment can be defined by the extension members, such as by having the extension members abut one another to define all or part of the main segment. Indeed, in such an embodiment, only one of the extension members need truly be provided so as to preserve a preferred, general symmetry of the system.

Figure 12:
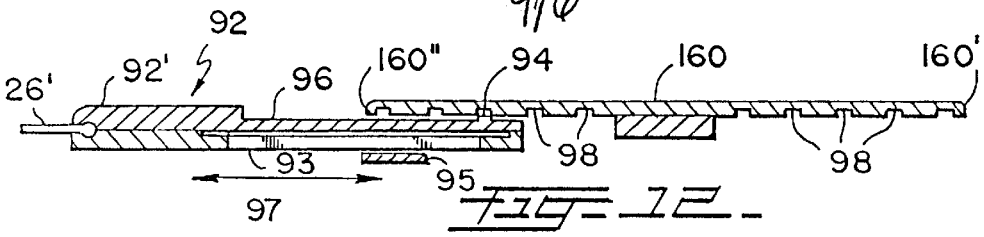
FIG. 12 is a partial sectional view of the embodiment of FIG. 11.
Figure 13:
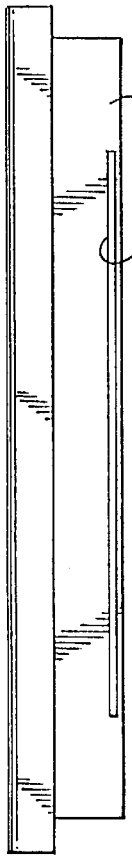
FIG. 13 is a top plan view of one structural component of the orienting device of the embodiment of FIGS. 11 and 12.
Figure 14:
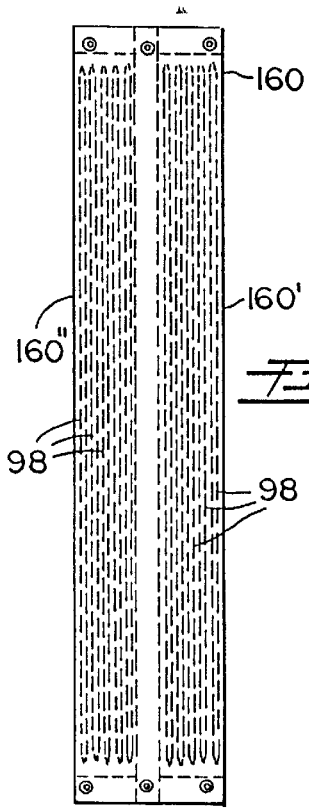
FIG. 14 is a top plan view of another structural component of the orienting device of the embodiment of FIGS. 11 and 12.

In the illustrated embodiment, each of the extension members 90 and 92 are preferably moveable independently of one another and are incrementally positionable at any varying distance from the main segment 160 due to the provision of a tongue and groove type assembly. The tongue and groove assembly comprises an integral or otherwise fixedly secured tongue 94, projecting outwardly from slide portion 96 of each of the extension members 90 and 92. The tongue 94 is dimensioned and configured to be removably received within any one of a plurality of elongated grooves 98 formed in spaced, substantially parallel relation to one another in the under surface of the main segment 160, as best shown in FIGS. 12 and 14. Further, the removable interconnection of the tongue 94 with anyone of the grooves 98 will facilitate the outwardly extending support or disposition of the extension members 90 and 92. For example, an under surface thereof, such as 93 may engage a support structure as at 95, which is secured to an underportion of the main segment 160, at any applicable location to provide somewhat of a cantilever-type support as the outwardly projecting tongue 94 and the under surface 93 of the extension member 92, simultaneously engage one of the grooves 98 and support structure 95, respectively. Accordingly, dependent upon the relative position between the main segment 160 and each of the extension members 90 and 92, the size of a central portion of the support surface, which includes the main segment 160, is effectively changed, based on the positioning of the support surfaces 90' and 92' towards and/or away from the main segment. The extension members 90 and 92 are particularly useful for folding of an unusually large garment and/or where the various garments or articles being folded continuously vary in size or configuration. In the latter situation the extension members 90 and 92 can easily and quickly be adjusted both towards an away from the main segment 160 to either reduce or expand the effective support surface, as described above.

Figure 11:
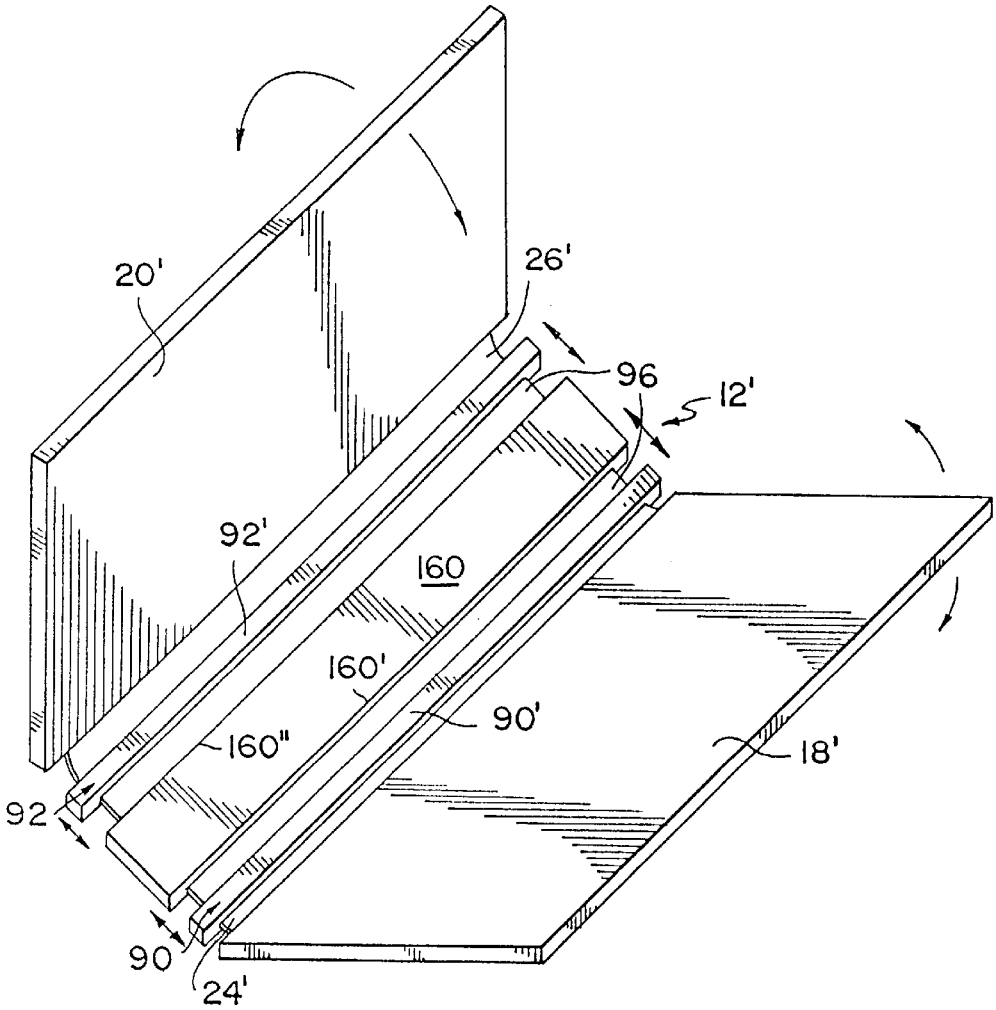
FIG. 11 is another embodiment of the folding assembly of the present invention incorporating an orienting device differing from the embodiment of FIGS. 1 through 3.
Figure 15:
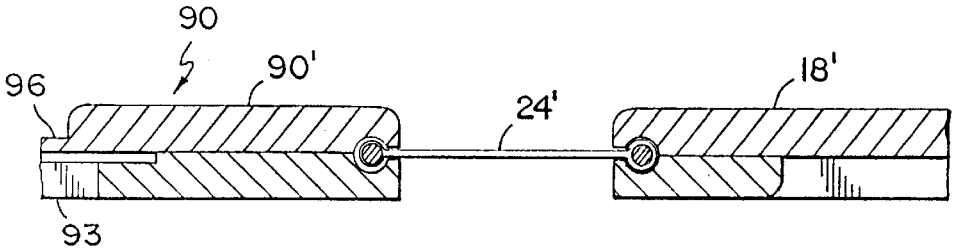
FIG. 15 is a sectional view in partial cutaway of a portion of the embodiment of the orienting device as shown in FIG. 11.

A structural modification also incorporated in the embodiment of FIGS. 11 through 15 includes the side panels 18' and 20' being movably connected to the correspondingly disposed extension members 90 and 92, respectively. More specifically, the flexible material connector members 24' and 26' movably connect or secure each of the side segments 18' and 20' to a corresponding one of the extension members 90 and 92 respectively, as shown in FIGS. 11 and 15. Operative positioning of each of the side segments 18' and 20' is substantially the same as described with regard to the embodiment of FIGS. 8 through 10, regardless of the outward disposition of the extension members 90 and 92 relative to the main segment 160.

Figure 17:
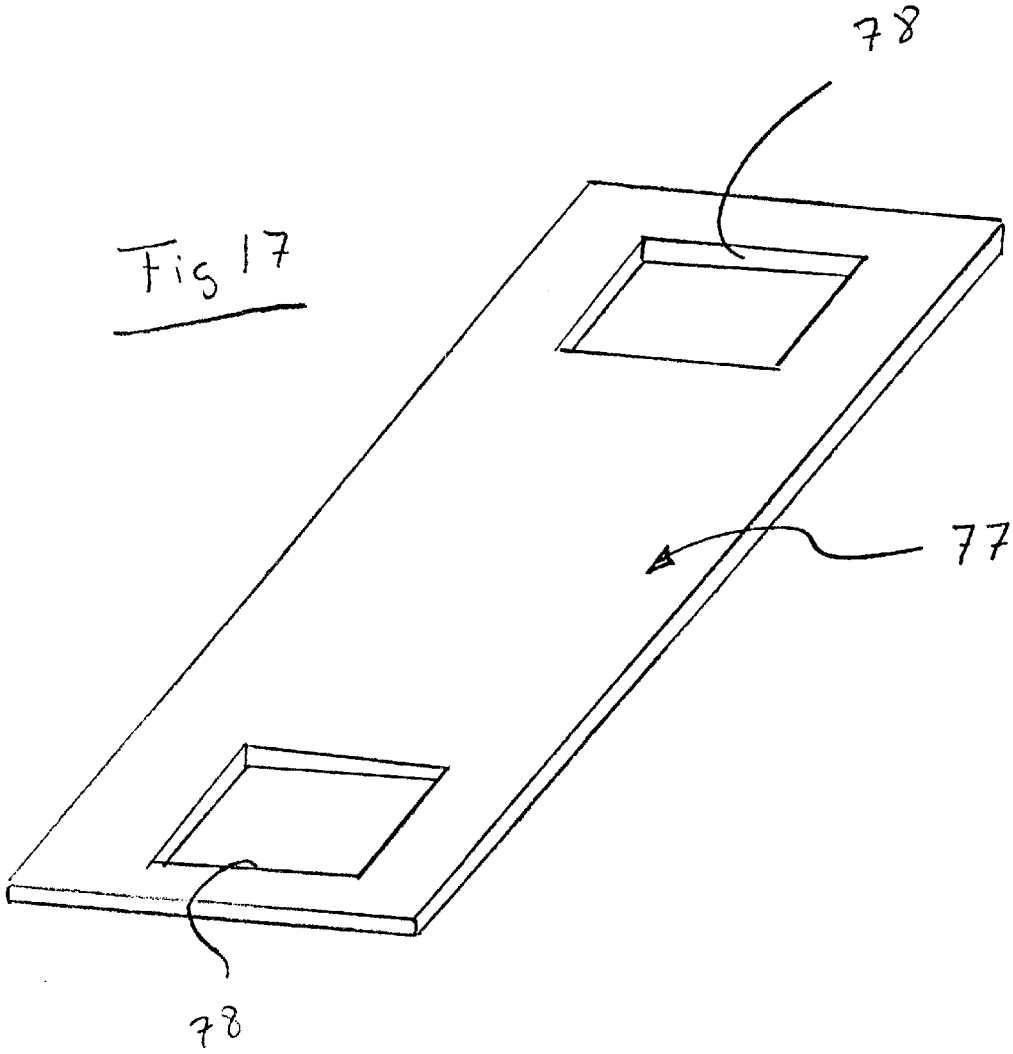
FIG. 17 is a perspective view of the alignment segment.

Looking to yet another structural component of the present invention, as detailed in FIG. 17, an alignment segment 77 may also be provided. The alignment segment 77 is preferably generally rigid and elongate, and may be of a similar length as that of the main segment. In the illustrated embodiment, the alignment segment 77 is formed of a rigid, generally flat panel. In use, the alignment segment 77 is structured to be disposed on the article, and especially on a pair of pants, after the article has been disposed on the main segment, but before the side segments are disposed in their overlapping relation to the main segment. In particular, the alignment segment 77 is especially beneficial in folding pants, so as to maintain an interior crease, such as at the crotch of pants, such as jeans. For example, when folding pants, such as jeans, it is beneficial to define a square folded unit that can fit into a compact storage and display area. As a result, to define the square shape it is generally beneficial to fold the crotch of a longitudinally folded pair of pants onto the main body of the pants prior to folding the legs and waist onto one another. As this region can sometimes be resilient, especially in jeans, the alignment segment 77 is structured to be disposed atop the folded crotch portion so as to maintain the crease defined thereby while the side segments are used to fold the legs and the waist portions on one another to define the folded article. As can be appreciated, a plurality of pants can be folded simultaneously, with the alignment segment 77 being sufficiently elongate to stretch onto each of the adjacent pairs of pants. Moreover, the alignment segment 77 preferably includes one or more handles 78 which facilitate sliding removal of the alignment segment 77 from within the folded pants. If desired, a hook or holding structure may be provided so as to secure the alignment segment to the remainder of the folding assembly 10, at least when the alignment segment 77 is not in use.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A folding assembly structured to arrange an article into a folded orientation, said folding assembly comprising:

a) an orienting device, said orienting device including a main segment and at least two side segments disposed in engaging relation to different portions of the article being folded, b) an attachment assembly securing each of said side segments to said orienting device in movable relation to said main segment, c) said side segments selectively positionable between an expanded position and a folded position; said expanded position at least partially defined by said side segments extending laterally outward from said main segment in spaced relation thereto and said folded position defined by each of said side segments independently disposed in substantially overlapping relation to said main segment, and d) said attachment assembly including at least two flexible material connectors each movably securing a different one of said side segments to said orienting device.

2. A folding assembly as recited in claim 1 further comprising a support assembly disposed in supporting engagement with said orienting device, said support assembly including a plurality of support members.

3. A folding assembly as recited in claim 2 wherein said support members are generally short in length.

4. A folding assembly as recited in claim 2 wherein said support assembly comprises an elongated configuration extending substantially vertically upward from a supporting surface into supporting engagement with said orienting device at an upper end of said support assembly.

5. A folding assembly as recited in claim 1 further including a pair of brace members structured to selectively extend into a supporting, operative position which engages each of said side segments.

6. A folding assembly as recited in claim 5 wherein said attachment assembly is structured to permit selective downward pivotal movement of said side segments, upon a corresponding one of said brace members being disposed in a retracted, inoperative position, so as to selectively reduce said size of said support surface.

7. A folding assembly as recited in claim 6 wherein each of said brace members is slidingly secured relative to said main segment.

8. A folding assembly as recited in claim 1 wherein said flexible material connectors are structured to define a variable, unplanned gap between said side segments and said main segment.

9. A folding assembly as recited in claim 1 wherein said main segment includes a center line defined thereon.

10. A folding assembly as recited in claim 1 further comprising a storage facility operatively associated therewith and structured to contain a plurality of said articles.

11. A folding assembly as recited in claim 1 wherein said orienting device further comprises at least one extension member moveable outwardly to selectively vary the effective size of said main segment.

12. A folding assembly as recited in claim 11 comprising at least two of said extension members.

13. A folding assembly as recited in claim 12 wherein each of said extension members is movably disposed in interconnecting relation between said main segment and a different one of said side segments.

14. A folding assembly as recited in claim 1 further comprising an alignment segment, said alignment segment structured to be disposed on the article after the article has been disposed on said main segment, but before said side segments are disposed in said overlapping relation to said main segment, said alignment segment being generally rigid and elongate.

15. A folding assembly as recited in claim 14 wherein said alignment segment is structured to maintain an interior crease of the article prior to its being folded, and includes a handle structured to facilitate removal of said alignment segment from an interior of the folded article.

16. A folding assembly structured to arrange an article into a folded orientation, said folding assembly comprising:

a) an orienting device, said orienting device including a main segment and at least two side segments disposed in engaging relation to different portions of the article being folded, b) an attachment assembly securing each of said side segments to said orienting device in movable relation to said main segment, c) said side segments selectively positionable between an expanded position and a folded position; said expanded position at least partially defined by said side segments extending laterally outward from said main segment in spaced relation thereto and said folded position defined by each of said side segments independently disposed in substantially overlapping relation to said main segment, and d) said attachment assembly structured to permit selective downward pivotal movement of said side segments, so as to selectively reduce said size of said orienting device.

17. A folding assembly structured to arrange an article into a folded orientation, said folding assembly comprising:

a) an orienting device, said orienting device including a main segment and at least two side segments disposed in engaging relation to different portions of the article being folded, b) an attachment assembly securing each of said side segments to said orienting device in movable relation to said main segment, c) said side segments selectively positionable between an expanded position and a folded position; said expanded position at least partially defined by said side segments extending laterally outward from said main segment in spaced relation thereto and said folded position defined by each of said side segments independently disposed in substantially overlapping relation to said main segment, and d) said main segment including a center line defined thereon.

18. A folding assembly structured to arrange an article into a folded orientation, said folding assembly comprising:

a) an orienting device, said orienting device including a main segment and at least two side segments disposed in engaging relation to different portions of the article being folded, b) an attachment assembly securing each of said side segments to said orienting device in movable relation to said main segment, c) said side segments selectively positionable between an expanded position and a folded position; said expanded position at least partially defined by said side segments extending laterally outward from said main segment in spaced relation thereto and said folded position defined by each of said side segments independently disposed in substantially overlapping relation to said main segment, e) said orienting device further including at least one extension member moveable outwardly to selectively vary the effective size of said main segment.

* * * * *

UNITED STATES PATENT AND TRADEMARK OFFICE

CERTIFICATE OF CORRECTION

PATENT NO. : 6,561,392 B2
DATED : May 13, 2003
INVENTOR(S) : Christine L. Lapace et al.

It is certified that error appears in the above-identified patent and that said Letters Patent is hereby corrected as shown below:

Column 11,
Line 9, should read -- and providing a gap of varying width between said side segments and said orientating device when the device is laid flat. --.

Signed and Sealed this

Tenth Day of January, 2006

JON W. DUDAS
*Director of the United States Patent and Trademark Office*